US010588439B2

(12) United States Patent
Charbeneau

(10) Patent No.: US 10,588,439 B2
(45) Date of Patent: Mar. 17, 2020

(54) PARCEL RECEIVING APPARATUS, COLLAPSIBLE BIN AND ASSOCIATED METHODS

(71) Applicant: Michael Patrick Charbeneau, Stamford, CT (US)

(72) Inventor: Michael Patrick Charbeneau, Stamford, CT (US)

( * ) Notice: Subject to any disclaimer, the term of this patent is extended or adjusted under 35 U.S.C. 154(b) by 22 days.

(21) Appl. No.: 15/922,081

(22) Filed: Mar. 15, 2018

(65) Prior Publication Data

US 2018/0199745 A1 Jul. 19, 2018

Related U.S. Application Data

(63) Continuation-in-part of application No. 15/360,493, filed on Nov. 23, 2016, now Pat. No. 9,955,812.

(60) Provisional application No. 62/259,737, filed on Nov. 25, 2015.

(51) Int. Cl.

| | |
|---|---|
| ***G07C 9/00*** | (2020.01) |
| ***A47G 29/14*** | (2006.01) |
| ***A47G 29/22*** | (2006.01) |

(52) U.S. Cl.

CPC ..... *A47G 29/141* (2013.01); *A47G 29/22* (2013.01); *G07C 9/00039* (2013.01); *A47G 2029/149* (2013.01)

(58) Field of Classification Search

CPC . G06K 5/00; G06K 7/01; G06K 19/00; G06F 17/00

USPC ..... 235/382, 375, 382.5, 487

See application file for complete search history.

(56) References Cited

U.S. PATENT DOCUMENTS

| | | | | |
|---|---|---|---|---|
| 6,412,688 | B1 | 7/2002 | Tucker et al. | |
| 6,722,561 | B1 | 4/2004 | Thomas et al. | |
| 7,946,472 | B2 | 5/2011 | Bolles | |
| 9,418,495 | B2 | 8/2016 | Mackin et al. | |
| 9,752,353 | B2 | 9/2017 | Matthews et al. | |
| 9,861,221 | B2 | 1/2018 | Jiang | |
| 9,955,812 | B2 | 5/2018 | Charbeneau | |
| 2002/0023949 | A1* | 2/2002 | Tucker | A47G 29/141 232/45 |

(Continued)

FOREIGN PATENT DOCUMENTS

| | | |
|---|---|---|
| JP | H05 16993 A | 1/1993 |
| WO | WO 2012/156659 A1 | 11/2012 |

OTHER PUBLICATIONS

EPO "International Search Report for related PCT patent application PCT/IB2018/059144", dated Mar. 4, 2019. (3 Pages).

(Continued)

*Primary Examiner* — Edwyn Labaze

(74) *Attorney, Agent, or Firm* — Mark Malek; Daniel C. Pierron; Widerman Malek, PL

(57) ABSTRACT

Embodiments of the present invention are related to a parcel bin for a parcel receiving apparatus that includes a receiving plate, a rotatable delivery plate, and a pair of parcel bin sides. The parcel bin sides include a pair of receiving plate sides and a pair of delivery plate sides. The pair of delivery plate sides are structured to be collapsible toward the delivery plate. The pair of receiving plate sides are fixedly attached to the receiving plate and structured to be non-rotatable. The rotatable delivery plate is structured to be collapsible toward the receiving plate.

20 Claims, 9 Drawing Sheets

(56) References Cited

U.S. PATENT DOCUMENTS

| | | | | |
|---|---|---|---|---|
| 2006/0169762 | A1* | 8/2006 | Irwin | A47G 29/22 232/45 |
| 2010/0006636 | A1* | 1/2010 | Frankenberg | A47G 29/122 232/44 |
| 2013/0293074 | A1* | 11/2013 | Skouboe | A47G 29/16 312/234 |
| 2016/0331171 | A1* | 11/2016 | Jiang | G06Q 10/0833 |
| 2018/0317687 | A1 | 11/2018 | Crooks | |

OTHER PUBLICATIONS

EPO "Written Opinion for related PCT patent application PCT/IB2018/059144", dated Mar. 4, 2019. (6 Pages).
USPTO, "Non-Final Office Action for related U.S. Appl. No. 15/360,493", dated Sep. 28, 2017 (9 Pages).
USPTO, "Notice of Allowance for related U.S. Appl. No. 15/360,493", dated Feb. 20, 2018 (7 Pages).

* cited by examiner

PARCEL RECEIVING APPARATUS, COLLAPSIBLE BIN AND ASSOCIATED METHODS

RELATED APPLICATIONS

This application is a Continuation-In-Part of U.S. patent application Ser. No. 15/360,493 titled Parcel Receiving Apparatus and Associated Methods, filed on Nov. 23, 2016 which, in turn, claims the benefit under 35 U.S.C. § 119(e) of U.S. Provisional Patent Application Ser. No. 62/259,737, titled Parcel Receiving Apparatus and Associated Methods, filed on Nov. 25, 2015, the entire contents of which are incorporated herein by reference.

FIELD OF THE INVENTION

The present invention relates to systems and methods for a parcel receiving apparatus.

BACKGROUND

Apparatuses for receiving packages without involving a person at the receiving location are known in the art. However, previous solutions have typically had substantial hardware requirements and expensive componentry and featured minimal security, relying on traditional methods of physical keys or combination dial locks. There is a need in the art for a package receiving solution that is versatile in terms of where it can be installed, the cost associated with such installation, and an increased level of security. Moreover, as automation technology progresses, there is a need in the art for a package receiving solution that facilitates automated delivery of packages.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a parcel receiving apparatus that may include a parcel bin for receiving parcels that may include a receiving plate, a rotatable delivery plate, and a pair of parcel bin sides. The parcel bin sides may include a pair of receiving plate sides and a pair of delivery plate sides. The pair of delivery plate sides may be structured to be collapsible toward the delivery plate. The pair of receiving plate sides may be fixedly attached to the receiving plate and structured to be non-rotatable. The rotatable delivery plate may be structured to be collapsible toward the receiving plate.

In this embodiment the pair of parcel bin sides may further include a pair of side latches and a pair of receiving notches. The pair of side latches may be structured to attach to the pair of receiving notches to secure the delivery plate sides to the receiving plate sides. Furthermore, the receiving notches may be configured to extend downward from a top edge of the receiving plate sides to create a female host for the side latches.

In some embodiments, the parcel bin may be structured to fit within a frame assembly. The frame assembly may include a top latch structured to secure the rotatable delivery plate in a collapsed position. Furthermore, the frame assembly may include pivot bolts structured to rotatably engage low friction bushings within the parcel bin. In this embodiment the pivot bolts and the low friction bushings may be structured to rotate the parcel bin within the frame assembly. In some embodiments the frame assembly may be structured to fit within an external structure such as a garage.

The present invention may include a parcel bin for receiving parcels that may include a receiving plate, a rotatable delivery plate, and a pair of parcel bin sides. The parcel bin sides may include a pair of receiving plate sides, a pair of delivery plate sides, a pair of side latches and a pair of receiving notches. The pair of side latches may be structured to attach to the pair of receiving notches to secure the delivery plate sides to the receiving plate sides. The pair of delivery plate sides may be collapsible toward the delivery plate and the rotatable delivery plate may be collapsible toward the receiving plate. In this embodiment the side latches may be elongate members attached to the outside of the parcel bin on the delivery plate side via a side swivel. Furthermore, at least one end of the side latches may be structured as a hook. The hook may be structured to engage an inside portion of the delivery plate at an overlapped section with the receiving plate when the side latches are in a closed position.

In this embodiment the parcel bin may be structured within a frame assembly and the frame assembly may include a top latch configured to secure the rotatable delivery plate in a collapsed position. Furthermore, the top latch may be attached to a latch control unit structured to automatically rotate the top latch when certain conditions are met. The conditions may include at least one of a garage door opening and a package being delivered.

The invention may also include a parcel receiving apparatus having a frame assembly including pivot bolts structured to rotatably engage low friction bushings. In this embodiment of the present invention, a parcel bin may be included. The parcel receiving bin may include low friction bushings structured to rotatably receive pivot bolts. The parcel bin may also include a receiving plate, a rotatable delivery plate, and a pair of parcel bin sides. The parcel bin sides may include a pair of receiving plate sides and a pair of delivery plate sides. The pair of delivery plate sides may be structured to be collapsible toward the delivery plate. The pair of receiving plate sides may be fixedly attached to the receiving plate and structured to be non-rotatable. Furthermore, the frame assembly may be structured to fit inside a support structure aperture and circumscribe the parcel bin. Also, the frame assembly pivot bolts may be structured to allow the parcel bin to rotate within the low friction bushings of the frame assembly.

This embodiment of the parcel receiving apparatus may further include a locking system. The locking system may be operable to permit or deny the parcel receiving apparatus from engaging an electric motor that automatically rotates the parcel receiving apparatus into an exterior open position upon successful entry of a personal identification number. Furthermore, the locking system may include a key pad, a display monitor, and a handle on an exterior front of the parcel bin. This embodiment may also include at least one electric motor structured to rotate the pivot bolts.

In this embodiment of the parcel receiving apparatus the frame assembly may further include a top latch. The top latch may be attached to a latch control unit. The latch control unit may be configured to automatically rotate the top latch when certain conditions are met.

DETAILED DESCRIPTION OF THE INVENTION

Figure 1:
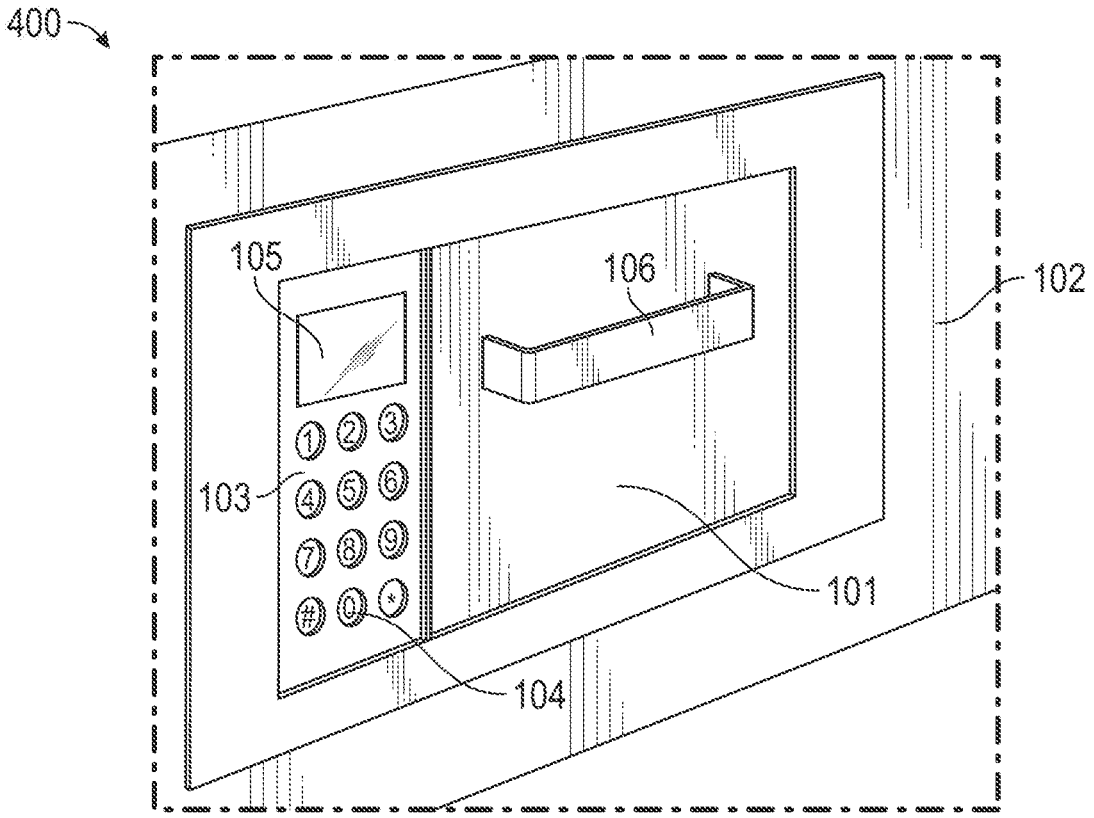
FIG. 1 is a perspective view of an exterior of a parcel receiving apparatus according to an embodiment of the invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a parcel receiving apparatus with associated methods. While the present embodiment of the parcel receiving apparatus is directed toward metal or metal alloy, any other material capable of providing structured support such as plastic, wood, or graphite is contemplated to be within the scope of the invention.

Some of the illustrative aspects of the present invention may be advantageous in solving the problems herein described and other problems not discussed which are discoverable by a skilled artisan.

Referring now to FIGS. 1-5, a parcel receiving apparatus 400 will now be discussed. The exterior of the parcel receiving apparatus 400 may include an outside frame that circumscribes a parcel bin 300. When in the closed position, the parcel bin exterior front 101 may be aligned and be parallel to a supporting structure 102 within which the parcel receiving apparatus 400 may be installed and carried. The parcel bin exterior front 101 may include a locking system 103 that may comprise a user interface, that in the present embodiment comprises a key pad 104 and display monitor 105. The locking system 103 may be configured to electronically allow or deny open access to the parcel bin 300 by permitting or denying rotation of the parcel bin 300. More specifically, the locking system 103 may be configured to prompt a user via the display monitor 105 to input a code, which the user may enter using the key pad 104. The locking system 103 may further indicate whether the code entered by the user was accepted or rejected via the display monitor 105. If the user enters an accepted code, the locking system 103 may allow access to the parcel bin 300.

Figure 6:
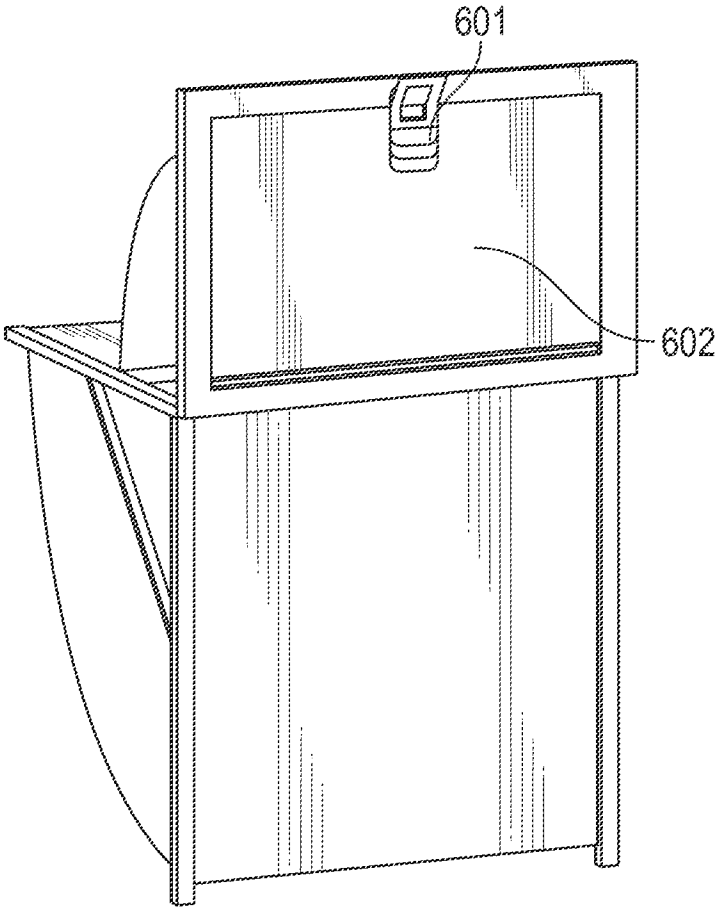
FIG. 6 is a perspective view of the exterior of the parcel receiving apparatus of FIG. 1 with a parcel bin in the closed position.

Additionally, the parcel bin exterior front 101 may include a handle 106 configured to facilitate a user's ability to open and close the parcel bin 300 from the outside once access has been allowed. In an alternate embodiment, the key pad 104 and display monitor 105 may be integrally formed with the handle on the exterior of the parcel receiving apparatus 400 as shown in FIG. 6, which will be discussed in greater detail hereinbelow. Additionally, the parcel bin exterior front 101 may include an attachable aesthetic panel to match the color of the supporting structure 102.

Figure 2:
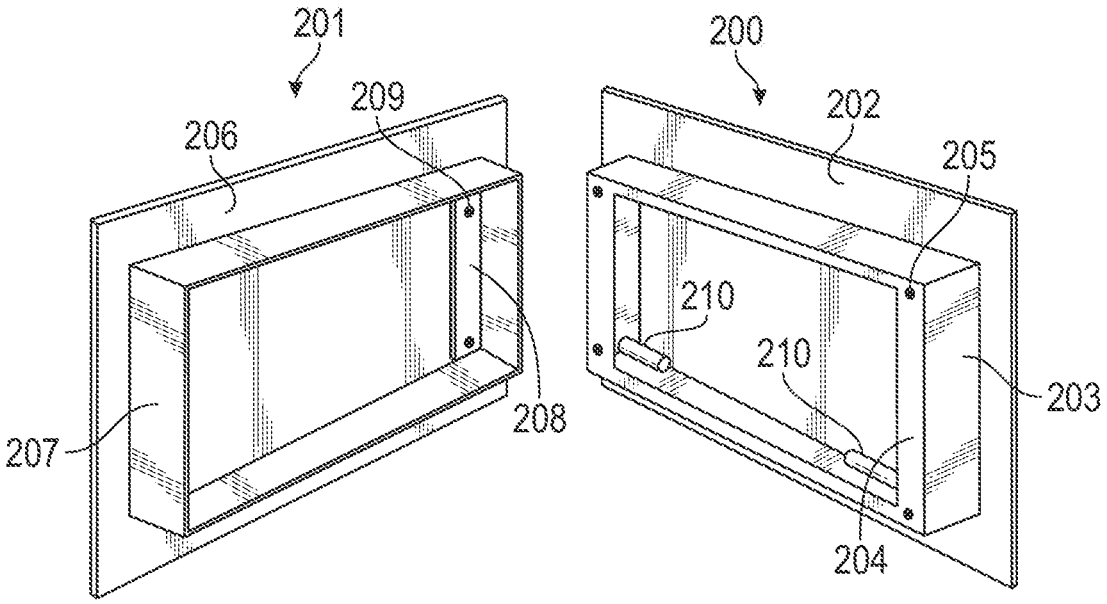
FIG. 2 is a perspective view of a disassembled frame assembly of the parcel receiving apparatus of FIG. 1.

Referring now specifically to FIG. 2, the parcel receiving apparatus 400 may comprise a parcel frame assembly 200 configured to secure the parcel receiving apparatus 400 to a supporting structure 102 while carrying the parcel bin 300. The frame assembly 200 may comprise an exterior frame structure 200 and an interior frame structure 201 configured to matingly engage each other through an appropriately sized aperture in the supporting structure 102. The exterior frame structure 200 may comprise an outside frame 202 that circumscribes an outside housing 203. The outside housing 203 may include an edge defined as an outside frame holding member 204 that contains outside screw holes 205 therein.

The interior frame structure 201 may comprise an inside frame 206 that circumscribes an inside housing 207. Attached to the interior of the inside housing 207 is an inside frame holding member 208 that contains inside screw holes 209. The interior frame structure 201 and exterior frame structure 200 may be fitted together through an aperture in the supporting structure 102 and secured to each other by means of screws configured to fit through the inside screw holes 209 and the outside screw holes 205. Each of the interior frame structure 201 and the exterior frame structure 200 may have a geometric configuration that facilitates attachment therebetween, and that may further cooperate with the aperture of the supporting structure 102.

Figure 3:
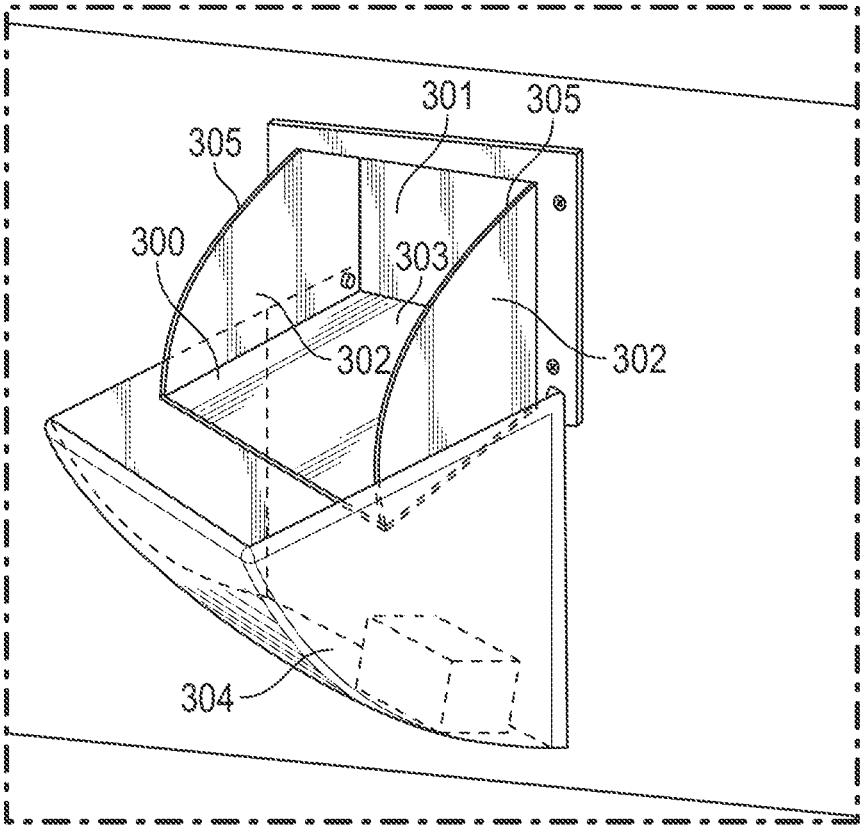
FIG. 3 is a perspective view of the interior components of the parcel receiving apparatus of FIG. 1.
Figure 4:
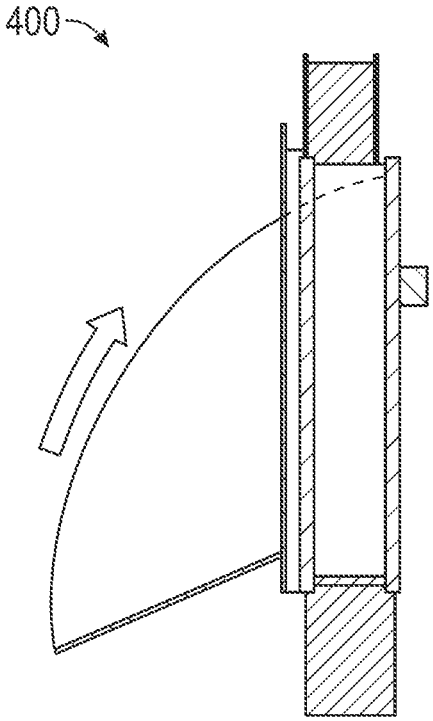
FIG. 4 is a side plan view of the parcel receiving apparatus of FIG. 1.

When fitted together, the inside housing 207 and the outside housing 203 may carry the parcel bin 300. Referring now additionally to FIG. 3, additional aspects regarding the parcel bin 300 will be discussed. The parcel bin 300 may be rotatably attached to the outside housing by pivot bolts 210. The pivot bolts 210 are threaded at a first segment and smooth at a second segment. The threaded segment is used to secure the pivot bolt 210 to the outside housing while the smooth segment is used to engage low friction bushings in the sides of the parcel bin 300. The pivot bolts 210 are configured to allow the parcel bin 300 to rotate about their smooth segments.

Figure 5:
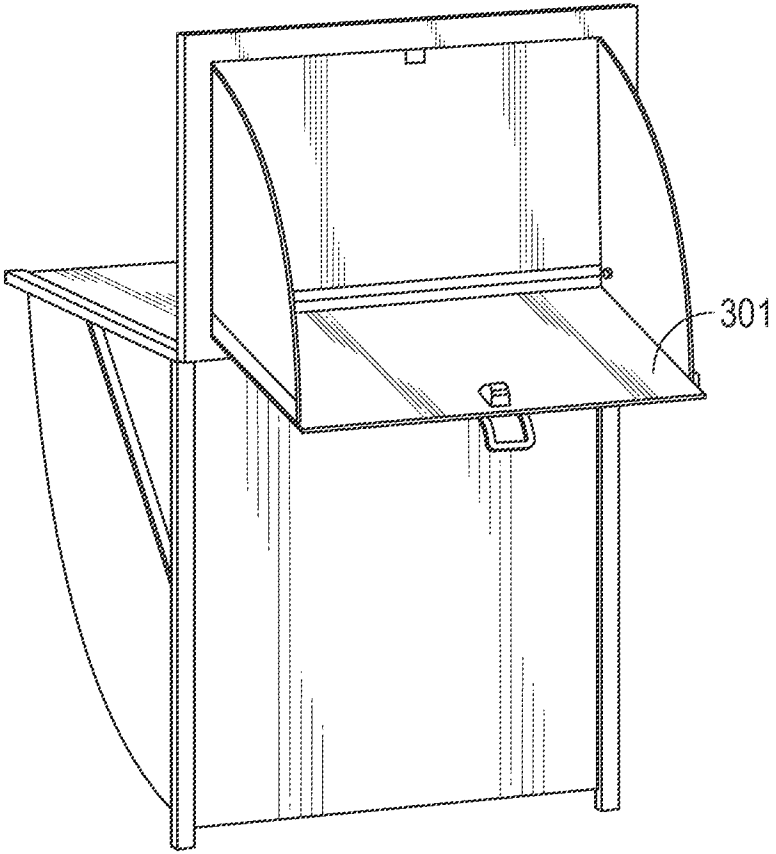
FIG. 5 is a perspective view of the exterior of the parcel receiving apparatus of FIG. 1 with a parcel bin in the open position.

The parcel bin 300 may include a flat receiving plate 301, parcel bin sides 302, and a sloped delivery plate 303. A first end of the flat receiving plate 301 and a first end of the sloped delivery plate 303 may be connected and may form an angle between 90 and 110 degrees in relation to each other. As shown in FIG. 5, when the parcel bin 300 is in a fully opened position from the exterior, the flat receiving plate 301 forms substantially a 90 degree angle with the supporting structure 102 and runs substantially parallel to the ground. This facilitates the placement of a delivered parcel thereon. When the parcel bin 300 is in the closed position from the outside, it is in an open position from the inside as demonstrated in FIG. 3 and FIG. 4. When the parcel bin 300 is in the open position from the inside, the sloped delivery plate 303 forms less than a 90-degree angle with the supporting structure 102 in order to facilitate a parcel sliding off of the sloped delivery plate 303 and into a flexible catch net 304 attached underneath or onto the ground. One of the parcel bin sides 302 is connected to a second end of the sloped delivery plate 303 and a second end of the flat receiving plate 301. Another parcel bin side 302 is connected to a third end of the sloped delivery plate 303 and a third end of the flat receiving plate 301. The parcel bin side edges 305 of the parcel bin sides 302 may be convex in shape in order to facilitate the movement of the parcel bin 300 between open and shut positions.

A method of using the parcel receiving apparatus 400 described in FIGS. 1-6 will now be discussed. The parcel receiving apparatus 400 will ideally be installed in a garage door, an exterior wall of a home or other building, or a fence. The locking system 103 will be secured by the owner of the parcel receiving apparatus 400 by way of a personal identification number ("PIN") chosen by the owner. A delivery person wishing to deliver a parcel to a specified address with a parcel receiving apparatus 400 would be given the PIN in advance as a part of the delivery instructions. The locking system 103 may be configured in a manner so that the owner can change the PIN after a single delivery, maintain the same PIN for all deliveries, or may be configured to create subsets of PINs for specific deliveries. The delivery person may type in the preset PIN in order to unlock the parcel receiving apparatus 400 from the outside. The delivery person may then use a handle or other means to open the parcel receiving apparatus 400 thereby placing the flat receiving plate substantially perpendicular to the ground as shown in FIG. 5. The delivery person then may place a parcel on the flat receiving plate 301 and return the parcel receiving apparatus 400 to its outside closed and locked position as shown in FIG. 6. As a result of returning the parcel receiving apparatus 400 to its outside closed and locked position, the parcel receiving apparatus 400 is placed into an inside open position as shown in FIG. 3. Furthermore, the parcel itself is transferred from the flat receiving plate 301 to the sloped delivery plate 303 in the process. The downward slope of the sloped delivery plate 303 allows the parcel to slide off of the sloped delivery plate 303 and into a flexible catch net 304 or onto the inside floor. One skilled in the art may recognize that a variety of catch net 304 devices may be utilized to carry out the functionality of holding the parcel. These devices may include a basket and a rolling thermal bin with a spring loaded lid for receiving cold deliveries.

Figure 7:
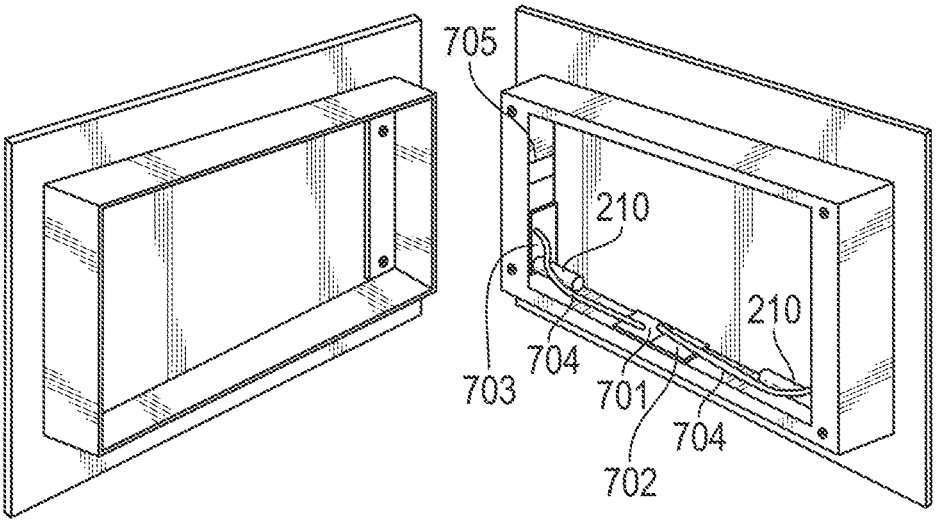
FIG. 7 is a perspective view of additional interior components according to an alternative embodiment of FIG. 3.

Referring now to FIG. 7, another embodiment of the parcel receiving apparatus 400 may have the parcel frame assembly 200 further include a microcontroller 701, a receiver 702, at least one electrical motor 703, and electrical coupling between the microcontroller 701 and the at least one electrical motor 703. In this embodiment the receiver 702 may be configured to receive an access code and transmit that code to the microcontroller 701. The microcontroller 701 may then compare the access code sent from the receiver 702 to a predefined code stored in memory of the microcontroller 701. If the access code sent from the receiver 702 matches the access code stored in the microcontroller 701 memory, then the microcontroller 701 may unlock the locking system 103 and signal the electric motor 703 to rotate the pivot bolts 210 thereby placing the parcel receiving apparatus 400 into an open position. For purposes of the remainder of this application, open and closed position shall refer to the orientation of the parcel bin 300 as viewed from the outside of a structure as depicted in FIG. 1. Furthermore, the microcontroller 701 may be configured to receive a code from the receiver 702, defined as a closing code, compare that closing code to a predefined closing code stored in memory and place the parcel receiving apparatus 400 into a closed position. When returned to a closed position the microcontroller 701 may signal the locking system 103 to once again lock the parcel receiving apparatus 400.

The receiver 702 may be operable to receive a wireless transmission from a remote device, such as one possessed by the user or one possessed by a robotic delivery device like a drone. The wireless transmission may be an electromagnetic transmission, for instance, a LASER transmission within at least one of the IR, visible, and ultraviolet spectra, and a radio frequency transmission. The transmission may include an identification code, resulting in the received transmission being at least one of a laser identification and a radio-frequency identification.

The code to open and close the parcel receiving apparatus may be the same or may be different. A person skilled in the art will appreciate that the microcontroller 701 memory may store a multitude of codes that, upon positive comparison from a received code from the receiver 702, may place the parcel receiving apparatus 400 into either an open or closed position.

In some embodiments, the microcontroller 701 may be operable to communicate across a network, such as a local area network (LAN), a personal area network (PAN), a cellular network, or a wide area network (WAN), such as the internet. Such communication may be accomplished using any wired or wireless communication standard as is known in the art, including, but not limited to, Ethernet, universal serial bus (USB), 802.11/WiFi, Bluetooth, Zigbee/Z-Wave, code division multiple access (CDMA), time division multiple access (TDMA), Global System for Mobile Communications (GSM), Long-Term Evolution (LTE), WiMAX, 5G mobile networks, and the like. Moreover, the microcontroller 701 may be operable to transmit information related to the parcel receiving apparatus 400 across the network to a remote computerized device, such as a personal computer, a mobile phone, a tablet computer, a server, and the like. Furthermore, the microcontroller 701 may be operable to receive transmissions from a remote computerized device, such as an online mobile device, and be configured by the received transmissions to affect the operation of the parcel receiving apparatus 400.

In some embodiments, the locking system 103 may comprise a timer (not shown) operable to provide an indication of the time of day or to provide a measured period of time to elapse before signaling the microcontroller 701 to open or close the parcel bin 300. Additionally, the parcel receiving apparatus 400 may comprise a sensor system comprising a sensor 705. The sensor may be operable to detect a status of the parcel receiving apparatus 400, such as, but not limited to, open and closed, with an open state being understood as the parcel bin 300 being ajar from the exterior. The sensor 705 may be any type of sensor as is known in the art, including, but not limited to, pressure sensors, optical sensors, magnetic sensors, and the like. Each of the timer and the sensor 705 may be positioned in electrical communication with the microcontroller 701. The microcontroller 701 may determine a length of time the parcel receiving apparatus 400 has been in an open or closed position based on signals received from each of the timer and the sensor 705. Furthermore, the microcontroller 701 may be operable to, upon determining the parcel receiving apparatus 400 has been in an open position for a threshold length of time, activate the electric motor 703 to close the parcel receiving apparatus 400.

In one operational embodiment, an identification as described hereinabove may be received from a robotic delivery device. The parcel bin 300 may then automatically be rotated to the open position upon authentication of the identification received from the robotic delivery device. The parcel bin 300 may then be automatically rotated into the closed position upon one of receipt of a closing code or an elapsed period of time.

Furthermore, the microcontroller 701 may be operable to communicate with the display monitor 105 to provide information regarding the status of the parcel receiving apparatus 400 (i.e. it may be opened, is currently open/ajar, is currently closed/locked) or a countdown regarding the time before the parcel receiving apparatus 400 will be closed.

Additionally, the microcontroller 701 may be positioned in communication with a security camera (not shown) that is positioned such that the parcel receiving apparatus 400 is within a field of view of the security camera. In some embodiments, the security camera may be positioned on the exterior frame structure 200. The microcontroller 701 may be operable to, upon receiving a signal from the sensor 705 that that the parcel receiving apparatus 400 is open, transmit a signal to the security camera to begin a video recording and send a video feed to at least one of the microcontroller 701 and a remote computerized device. This video feed may thereby capture a parcel being delivered.

Figure 8:
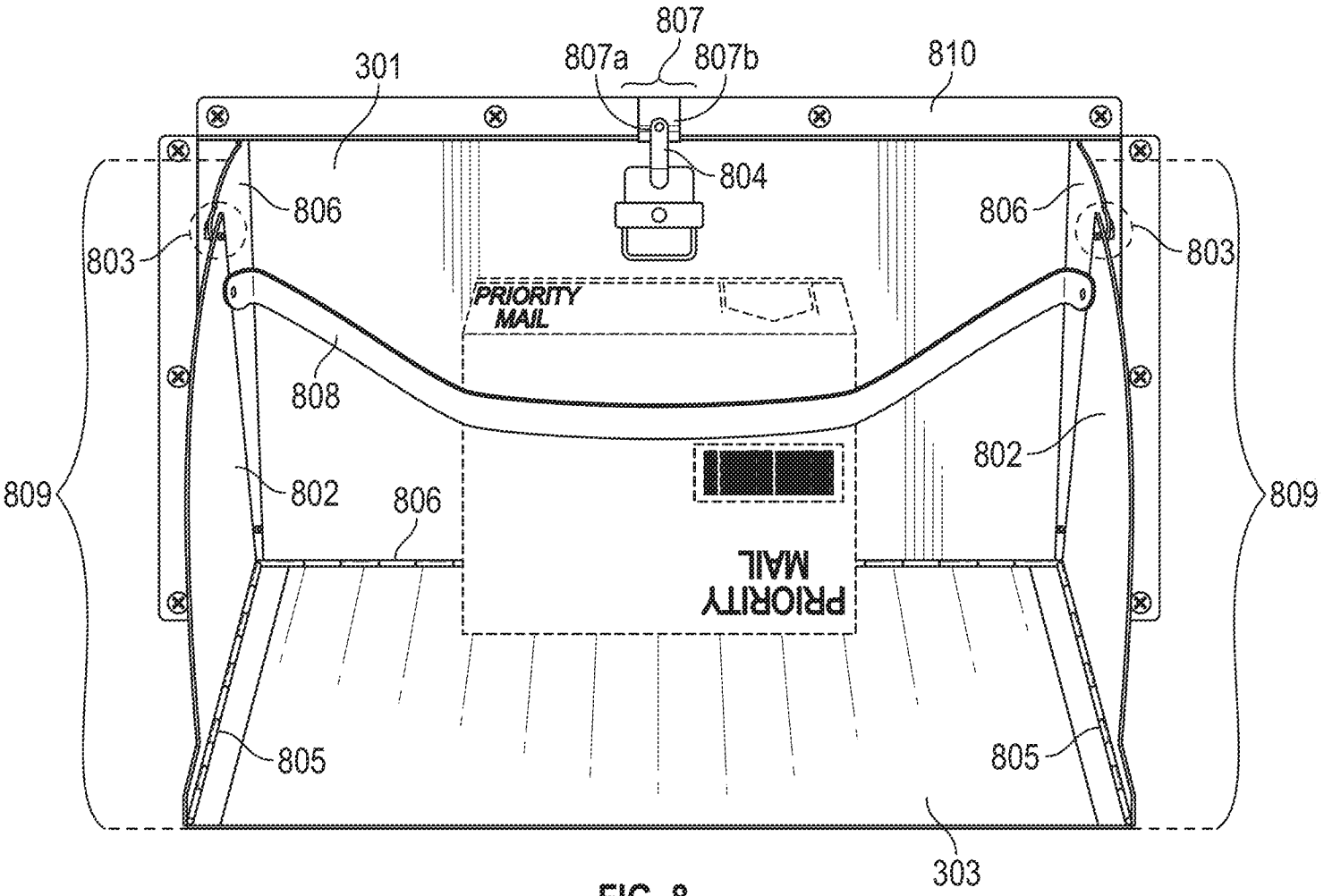
FIG. 8 is a front perspective view of another embodiment of the parcel bin.

Referring additionally to FIG. 8, another embodiment of the parcel bin 800 may include parcel bin sides 809 that are modularized into four components. The four components may include a pair of opposing delivery plate sides 802 and a pair of opposing receiving plate sides 806. A first portion of the receiving plate sides 806 may be fixedly attached to the flat receiving plate 301. A second portion of the receiving plate sides 806 may removably attach to the pair of delivery plate sides 802. The attachment may be accomplished via a pair of side latch assemblies 803 located on an upper portion of the delivery plate sides 802 and the receiving plate sides 806.

While the pair of opposing receiving plate sides 806 may be fixedly attached to the receiving plate 301, the pair of delivery plate sides 802 may be rotatable along a pair of side hinges 805 located along a bottom portion of the delivery plate sides 802 and opposing side portions of the sloped delivery plate 303. The side hinges 805 may include only a single hinge or may include a plurality of hinges. In some embodiments the side hinges 805 may encompass the entire latitudinal edges of the sloped delivery plate 303 and the entire bottom edges of the delivery plate sides 802. In some embodiments the side hinges 805 may include only a portion of the latitudinal edges of the sloped delivery plate 303 and only a portion of the bottom edges of the delivery plate sides 802.

When unlatched from the receiving plate sides 806, the delivery plate sides 802 may rotate along the side hinges 805 toward an open face of the sloped delivery plate 303 within the interior of the parcel bin 800. Furthermore, when the receiving plate sides 806 are detached from the delivery plate sides 802, the sloped delivery plate 303 may rotate along back hinges 806 toward an open face of the flat receiving plate 301 within the interior of the parcel bin 800. The back hinges 806 may include a plurality of hinges or may only include a single hinge. The back hinges 806 may be located along the entire bottom edge of the flat receiving plate 301 and an entire longitudinal edge of the sloped delivery plate 303. In some embodiments the back hinges 805 may include only a portion of the longitudinal edge of the sloped delivery plate 303 and only a portion of the bottom edge of the sloped delivery plate 303.

The parcel bin 800 may also include a belt 808 secured to an open face surface of the receiving plate sides 806. The belt may attach to one receiving plate side 806 and may extend across a longitudinal interior of the parcel bin 800 and attach to an opposing receiving plate side 806. The belt 808 may be made of any durable material including but not limited to rubber, plastic, nylon, thread, rope, and fabric.

The parcel bin 800 may also include a top latch assembly 807. The top latch assembly 807 may include an elongate top latch 804 structured to rotate between a position perpendicular with a frame 810 and a position parallel with the frame 810. In some embodiments the top latch 804 may be attached to a latch control unit **807*b* via a top swivel 807*a* located on one end of the top latch 804. In some embodiments the latch control unit 807*b* may cause for the top latch 804 to automatically rotate when certain conditions are met. Furthermore, in some embodiments the latch control unit 807*b* may be in communication with the microcontroller 701 to receive instructions as to when the top latch 804 is to be rotated. Some conditions may include when a sensor indicates a garage door is opening or when a package is being delivered according to previously described embodiments. In other embodiments the latch control unit 807*b* may allow for a user to manually rotate the top latch 804 about the top swivel 807*a*** between a perpendicular and parallel position.

Figure 9A:
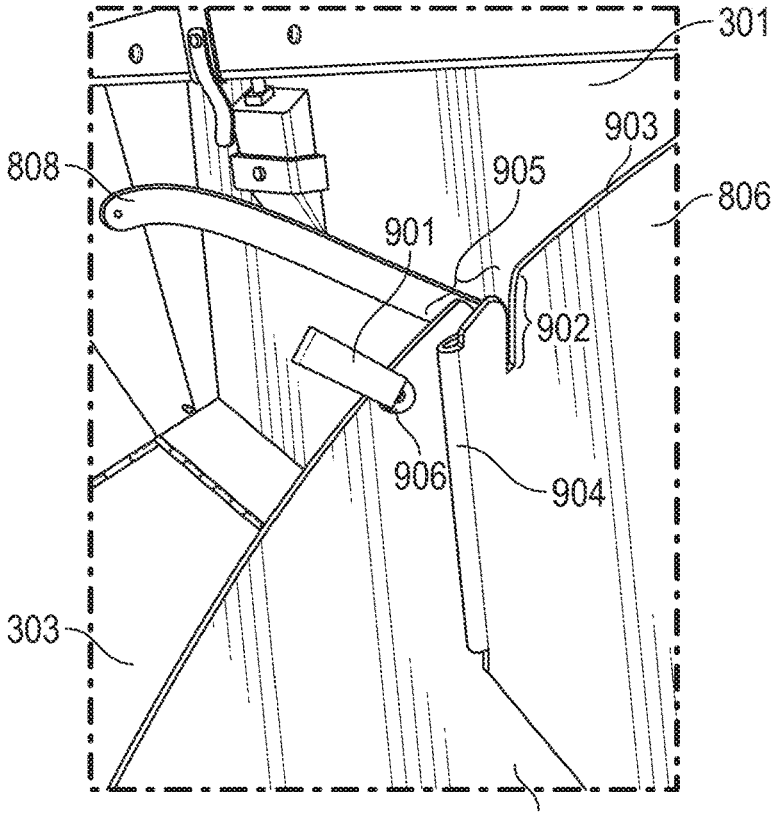
FIG. 9*a* is a side perspective view of the latching system illustrated in FIG. 8.
Figure 9B:
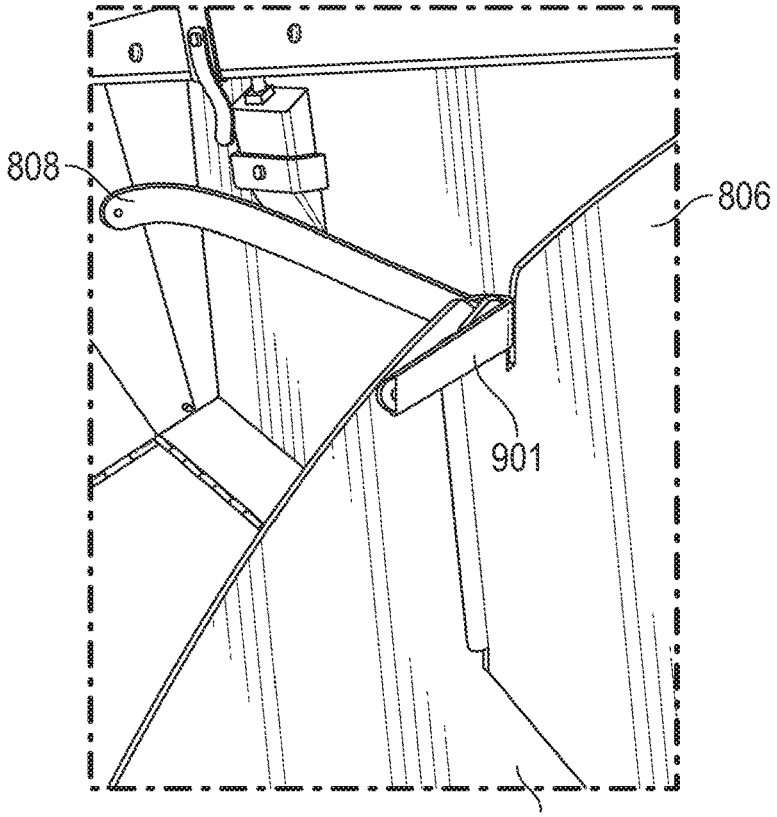
FIG. 9*b* is a side perspective view of the latching system illustrated in FIG. 8.

FIGS. 9*a* and 9*b* illustrate the parcel bin sides 809 in their upright position and demonstrate the mechanics of the side latch assembly 803. As depicted in FIG. 9*a*, the receiving plate side 806 may include a top edge 902. The top edge 902 may be downward sloped as it extends from its attachment point at the flat receiving plate 301. A portion of the top edge 902 distal to the receiving plate side 806 may include a receiving notch 902. The receiving notch 902 may extend downward from the top edge 902 into the receiving plate side 806 to create a female host for a side latch 901 attached to the delivery plate side 802. The receiving notch 902 may be at a distance from a vertical edge 904 of the receiving plate side 806 to accommodate a longitudinal portion of the side latch 901.

The side latch 901 may be an elongate member attached to the outside of the parcel bin 800 on the delivery plate side 802 via a side swivel 906. In some embodiments the side latch 901 may be attached via a rivet. In any embodiment, a 740*n* end of the side latch 901 distal the side swivel 906 may form a hook that faces the inside of the parcel bin 800. When in its upright position, the delivery plate side 802 may have a portion that abuts the inside of the receiving plate side 806 to form a segment where the delivery plate side 802 and the receiving plate side 806 overlap 905. In some embodiments, the vertical edge 904 may be formed as an elongate cylinder to add girth to the overlap 905. FIG. 9*a* demonstrates the side latch 901 in an open position.

FIG. 9*b* illustrates the side latch 901 in a closed position. The side latch 901 may rotate toward the receiving plate side 806 around the vertical edge 904 and attach within the receiving notch 902. In some embodiments the added girth of the vertical edge 904 may provide for a tighter fit when the side latch 901 may be secured to the receiving notch 902. Furthermore, in some embodiments the hooked portion of the side latch 901 may be long enough to extend around the overlap 905 on the inside of the parcel bin 800 to further reinforce the attachment of the delivery plate side 802 to the receiving plate side 806.

Figure 10:
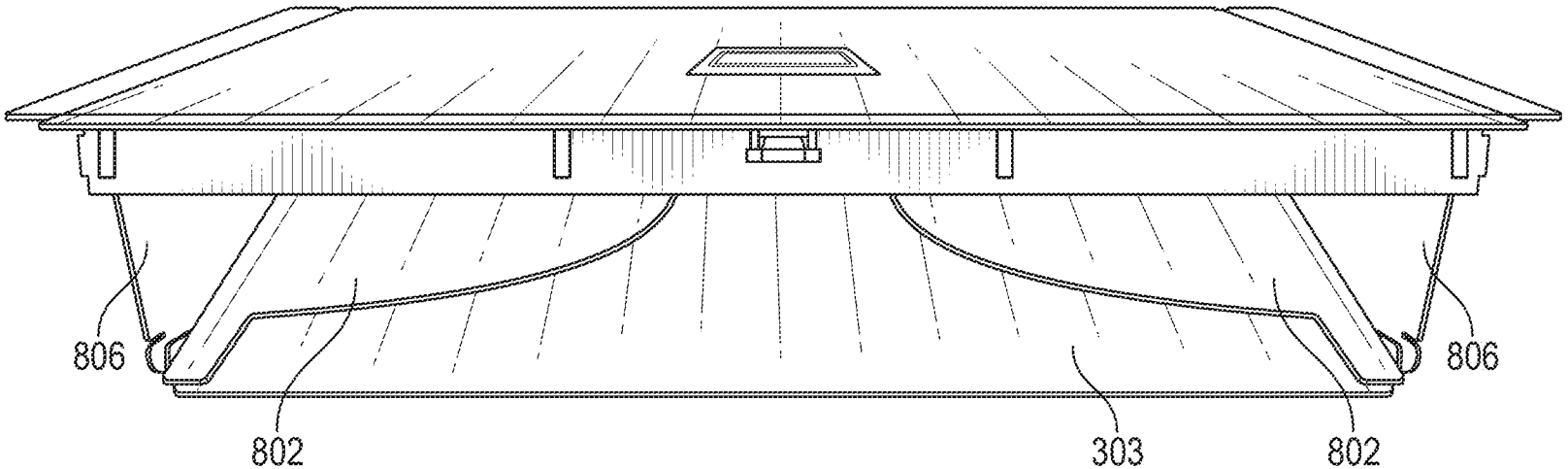
FIG. 10 is a top perspective view of a partially collapsed parcel bin according to an embodiment of the invention.

FIG. 10 illustrates the collapsible nature of the parcel bin 800. Although the receiving plate sides 806 maintain their structural integrity, the delivery plate sides 802 are shown as being rotated along the side hinges 805 and collapsed against the sloped delivery plate 303. Furthermore, the sloped delivery plate 303 is rotated along the back hinges 806 to demonstrate the overall compactible nature of the parcel bin 800.

Figure 11:
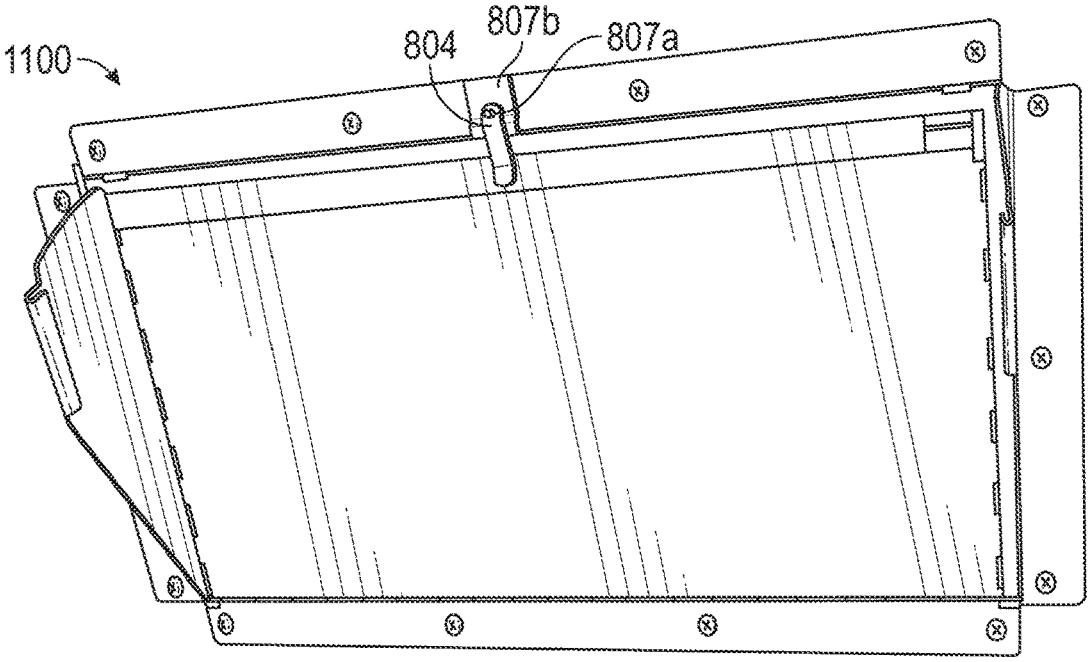
FIG. 11 is a perspective view of a fully collapsed parcel bin according to an embodiment of the invention.

FIG. 11 shows the parcel bin 800 in its collapsed and latched position with the top latch 804 in a vertical orientation. In this orientation, the delivery plate sides 802 are rotated and abutting the inside of the sloped delivery plate 303 (not shown). The top latch 804 may secure the sloped delivery plate 303 to the frame 810 to keep the parcel bin 800 in its collapsed position. A collapsed position is not only important because it provides a more compact product for initial shipping and packaging, but a collapsed position reduces the overall size of the parcel bin 800 when it is installed within a car garage.

Figure 12:
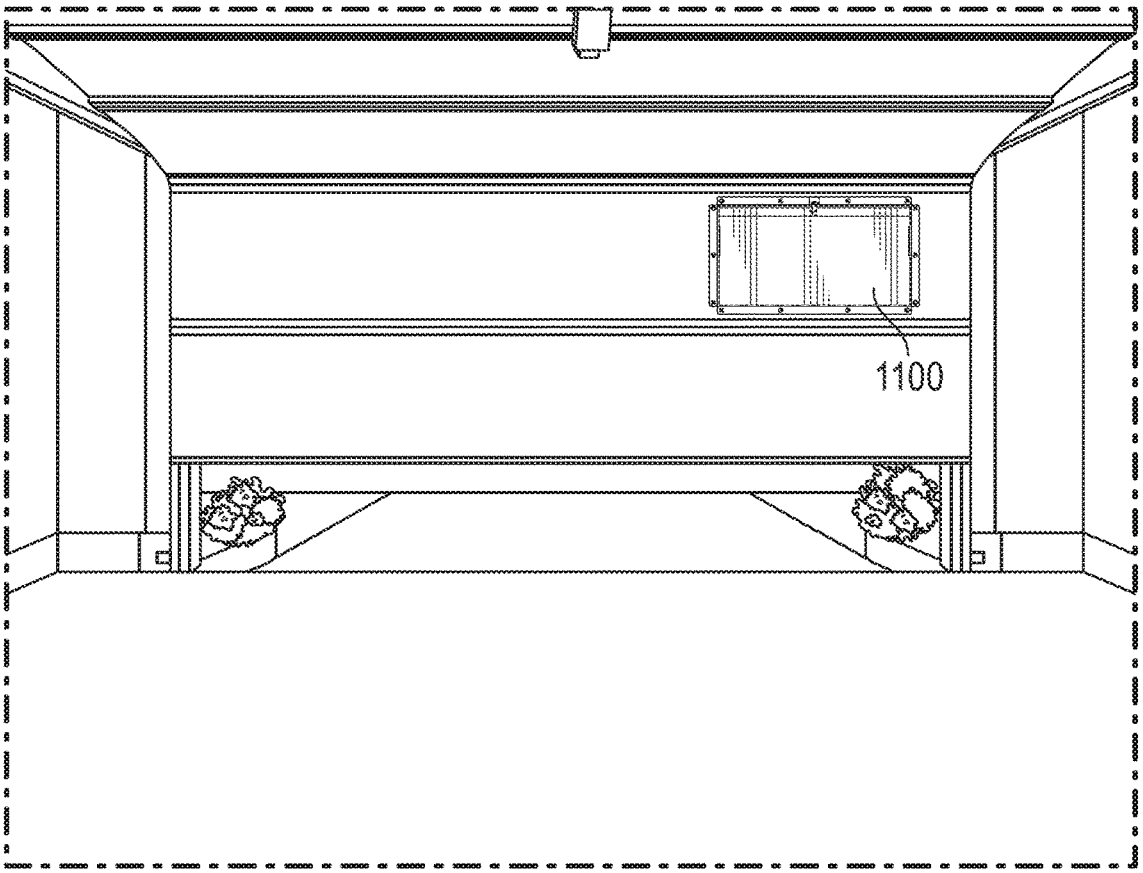
FIG. 12 is a front view of a parcel bin fitted within an external structure according to an embodiment of the invention.

FIG. 12 illustrates that the collapsed position may allow more room for cars to fit within the garage. By way of non-limiting example, when the garage door is in a closed position, the collapsed position of the parcel bin 800 may provide for more space behind a car parked within the garage. Furthermore, when the garage door is in a fully opened position, the collapsed position of the parcel bin 800 may allow for additional vertical clearance of cars within the garage.

Figure 13:
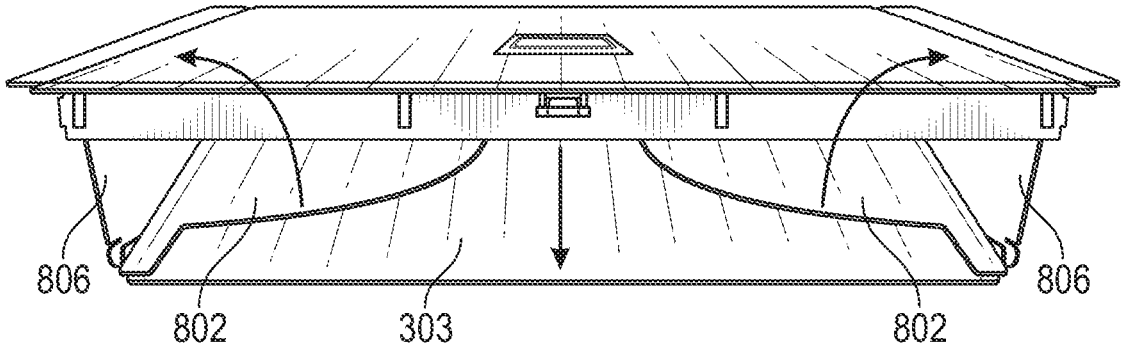
FIG. 13 is a top perspective view of a partially collapsed parcel bin illustrating the rotating features according to one embodiment.
Figure 14:
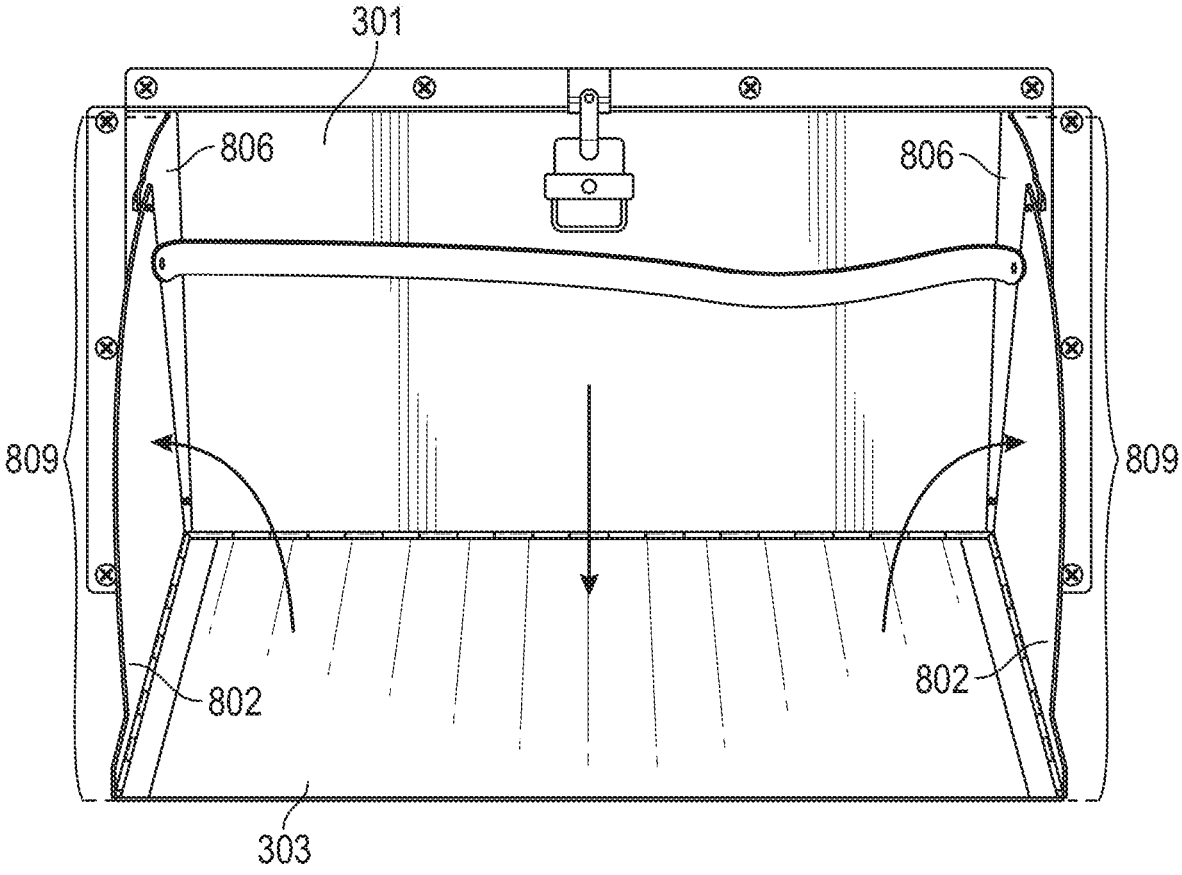
FIG. 14 is a front perspective view of an opened parcel bin according to an embodiment of the invention.

FIGS. 13 and 14 illustrate how the parcel bin 800 may be transitioned from a collapsed position to an open position. Although not specifically shown, the top latch 804, at least initially, may be rotated to a horizontal position. This may allow for the sloped delivery plate 303 to rotate about the back hinges 806 distally from the frame. Either simultaneously or successively, the delivery plate sides 802 may be rotated about the side hinges 805 distally from the sloped delivery plate 303. Once the sloped delivery plate 303 has reached its capacity angle, it may lock into place. Once the delivery plate sides 802 have reached their capacity vertical orientation, they may be secured to the receiving plate sides 806 via the side latches 901. At this point the parcel bin 800 may operate similarly to any of the other embodiments described herein.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus, the scope of the invention should be determined by the appended claims and their legal equivalents, and not by the examples given.

That which is claimed is:

1. A parcel bin operable to receive parcels comprising:
a receiving plate;
a rotatable delivery plate;
a pair of parcel bin sides comprising:
a pair of receiving plate sides;
a pair of delivery plate sides;
wherein the pair of delivery plate sides are configured to be collapsible toward the delivery plate;
wherein the pair of receiving plate sides are fixedly attached to the receiving plate and configured to be non-rotatable;
wherein the rotatable delivery plate is configured to be collapsible toward the receiving plate.

2. The parcel bin of claim 1 wherein the pair of parcel bin sides further comprises a pair of side latches and a pair of receiving notches; and wherein the pair of side latches are configured to attach to the pair of receiving notches to secure the delivery plate sides to the receiving plate sides.

3. The parcel bin of claim 2 wherein the receiving notches are configured to extend downward from a top edge of the receiving plate sides to create a female host for the side latches.

4. The parcel bin of claim 1 wherein the parcel bin is configured within a frame assembly; and wherein the frame assembly includes a top latch configured to secure the rotatable delivery plate in a collapsed position.

5. The parcel bin of claim 4 wherein the frame assembly comprises pivot bolts configured to rotatably engage low friction bushings within the parcel bin; and wherein the pivot bolts and the low friction bushings are configured to rotate the parcel bin within the frame assembly.

6. The parcel bin of claim 4 wherein the frame assembly is configured to fit within an external structure.

7. The parcel bin of claim 6 wherein the external structure is a garage door.

8. A parcel bin operable to receive parcels comprising:
- a receiving plate;
- a rotatable delivery plate,
- a pair of parcel bin sides comprising:
  - a pair of receiving plate sides;
  - a pair of delivery plate sides;
  - a pair of side latches and a pair of receiving notches;
  - wherein the pair of side latches are configured to attach to the pair of receiving notches to secure the delivery plate sides to the receiving plate sides;
  - wherein the pair of delivery plate sides are collapsible toward the delivery plate;
- wherein the rotatable delivery plate is collapsible toward the receiving plate.

9. The parcel bin of claim 8 wherein the side latches are elongate members attached to the outside of the parcel bin on the delivery plate side via a side swivel.

10. The parcel bin of claim 8 wherein at least one end of the side latches is configured as a hook.

11. The parcel bin of claim 10 wherein the hook is configured to engage an inside portion of the delivery plate at an overlapped section with the receiving plate when the side latches are in a closed position.

12. The parcel bin of claim 8 wherein the parcel bin is configured within a frame assembly; and wherein the frame assembly includes a top latch configured to secure the rotatable delivery plate in a collapsed position.

13. The parcel bin of claim 12 wherein the top latch is attached to a latch control unit; and wherein the latch control unit is configured to automatically rotate the top latch when certain conditions are met.

14. The parcel bin of claim 13 wherein a condition includes at least one of a garage door opening and a package being delivered.

15. A parcel receiving apparatus comprising:
- a frame assembly comprising pivot bolts configured to rotatably engage low friction bushings;
- a parcel bin comprising:
  - low friction bushings configured to rotatably receive pivot bolts;
  - a receiving plate,
  - a rotatable delivery plate,
  - a pair of parcel bin sides comprising:
    - a pair of receiving plate sides;
    - a pair of delivery plate sides;
  - wherein the pair of delivery plate sides are configured to be collapsible toward the delivery plate;
  - wherein the pair of receiving plate sides are fixedly attached to the receiving plate and configured to be non-rotatable;
- wherein the frame assembly is configured to fit inside a support structure aperture and circumscribe the parcel bin;
- wherein the frame assembly pivot bolts are configured to allow the parcel bin to rotate within the low friction bushings of the frame assembly.

16. The parcel receiving apparatus of claim 15 further including a locking system; and wherein the locking system is operable to permit or deny the parcel receiving apparatus from engaging an electric motor that automatically rotates the parcel receiving apparatus into an exterior open position upon successful entry of a personal identification number.

17. The parcel receiving apparatus of claim 16 wherein the locking system comprises a key pad, a display monitor, and a handle on an exterior front of the parcel bin.

18. The parcel receiving apparatus of claim 15 further including at least one electric motor configured to rotate the pivot bolts.

19. The parcel receiving apparatus of claim 15 wherein the frame assembly further includes a top latch.

20. The parcel receiving apparatus of claim 19 wherein the top latch is attached to a latch control unit; and wherein the latch control unit is configured to automatically rotate the top latch when certain conditions are met.

* * * * *